US005865053A

United States Patent [19]

Abbey, III et al.

[11] Patent Number: 5,865,053

[45] Date of Patent: Feb. 2, 1999

[54] TRANSITION BEAM FORMING SECTION FOR TUBE MILL

[75] Inventors: Nelson D. Abbey, III, Montclova; John M. Seminew, Perrysburg; Susan J. Taber, Gibsonburg, all of Ohio

[73] Assignee: Abbey Etna Machine Company, Perrysburg, Ohio

[21] Appl. No.: 815,332

[22] Filed: Mar. 10, 1997

Related U.S. Application Data

[63] Continuation-in-part of Ser. No. 603,395, Feb. 20, 1996, abandoned.

[51] Int. Cl.[6] ..... B21D 39/02; B21D 5/08

[52] U.S. Cl. ..... 72/52; 72/176

[58] Field of Search ..... 72/52, 176, 178, 72/181, 367, 368; 74/109

[56] References Cited

U.S. PATENT DOCUMENTS

| | | | |
|---|---|---|---|
| 3,468,150 | 9/1969 | Ruple | 72/178 |
| 4,393,907 | 7/1983 | Konstadt | 74/109 |
| 4,487,046 | 12/1984 | Abbey, III | 72/52 |
| 4,697,446 | 10/1987 | Yamamoto et al. | 72/178 |
| 4,747,289 | 5/1988 | Nakamura | 72/52 |
| 4,756,204 | 7/1988 | Wittwer et al. | 74/109 |

*Primary Examiner*—Lowell A. Larson
*Assistant Examiner*—Rodney Butler
*Attorney, Agent, or Firm*—Donald R. Fraser

[57] ABSTRACT

A transition forming unit for a tube mill is provided for forming a strip into a generally annular shaped cross-sectional configuration. The forming process is performed by a plurality of roll assemblies mounted on at least a pair of spaced longitudinally extending beams, one disposed on each side of the longitudinal axis of the forming unit. The beams are mounted to rotate about their longitudinal axis and are horizontally and vertically adjustable.

2 Claims, 5 Drawing Sheets

TRANSITION BEAM FORMING SECTION FOR TUBE MILL

This is a continuation-in-part application of U.S. patent application Ser. No. 08/603,395 filed Feb. 20, 1996, now abandoned.

BACKGROUND OF THE INVENTION

This invention generally relates to tube forming mills and, more particularly, to an intermediate transition beam section for forming a strip of metal having a U-shaped cross-sectional configuration into a tube typically having an annular cross-sectional configuration.

In the manufacture of welded metal tubing formed from a flat strip of material, the use of materials having high yield strength has created problems in the forming operation. More specifically, the high yield strength of the metal strip tends to cause the section being formed to "spring back" thereby causing an undesired cross-sectional configuration presenting alignment of the material being formed prior to its entry into the succeeding forming roll sections, such as passing from the transition section to the fin roll section of the mill.

A production of heavy gauge, large diameter tubing initially requires passing stock to be formed through a number of driven rollers to effect the break down or transformation of the flat strip into a strip of generally U-shaped cross-section. Thence, the U-shaped strip is transformed into a generally annular shaped cross-section by causing the strip to pass through a cluster or transition roll section prior to its entry into a fin roll assembly to assure proper alignment of the abutting edges of the formed strip preparatory to a seam welding operation. In such operations, the mill may be operated at speeds of typically of 80 feet per minute, for example. Accordingly, in the event of a "spring back" of the leading edge of the formed strip prior to entry into the fin roll assembly, the leading edge will strike the rolls causing damage to the leading edge of the strip being formed, the roll surfaces, and the supporting bearings necessitating repair and replacement and costly shutdown time.

These problems are compounded when heavy gauge strip stock is fed into the forming mill in discrete lengths rather than in continuous lengths requiring constant attention to the proper alignment of each length throughout the mill prior to entry into the fin pass rolls to assure to the proper alignment of the abutting edges preparatory to seam welding operations.

SUMMARY OF THE INVENTION

U.S. Pat. No. 4,487,046 discloses a transition forming unit including a plurality of roll assemblies adjustably mounted on a pair of spaced apart longitudinally extending beams, one disposed on each side of the longitudinal axis of the forming unit. The beams are adjustable in the X and Y axes.

The above apparatus has been found to be satisfactory in the transition section of tube mills employed to produce tubing of a range of wall thickness and overall size.

The present invention overcomes the above described, as well as other, problems of the prior art and is considered to be an improvement over the apparatus disclosed in the aforementioned patent, by providing a tube mill having a transition forming section disposed between the outlet of the initial forming section and the inlet to the fin roll section which assures the proper universal alignment.

Further objects and advantages of this invention will be apparent from the following description and appended claims, reference being made to the accompanying drawings forming a part of the specification, wherein like reference characters designate corresponding parts in the several views.

BRIEF DESCRIPTION OF THE DRAWINGS

The above, as well as other objects and advantages of the invention will become readily apparent to those skilled in the art from reading the following detailed description of a preferred embodiment of the invention when considered in the light of the accompanying drawings, in which.

DETAILED DESCRIPTION OF THE PREFERRED EMBODIMENT

Figure 1:
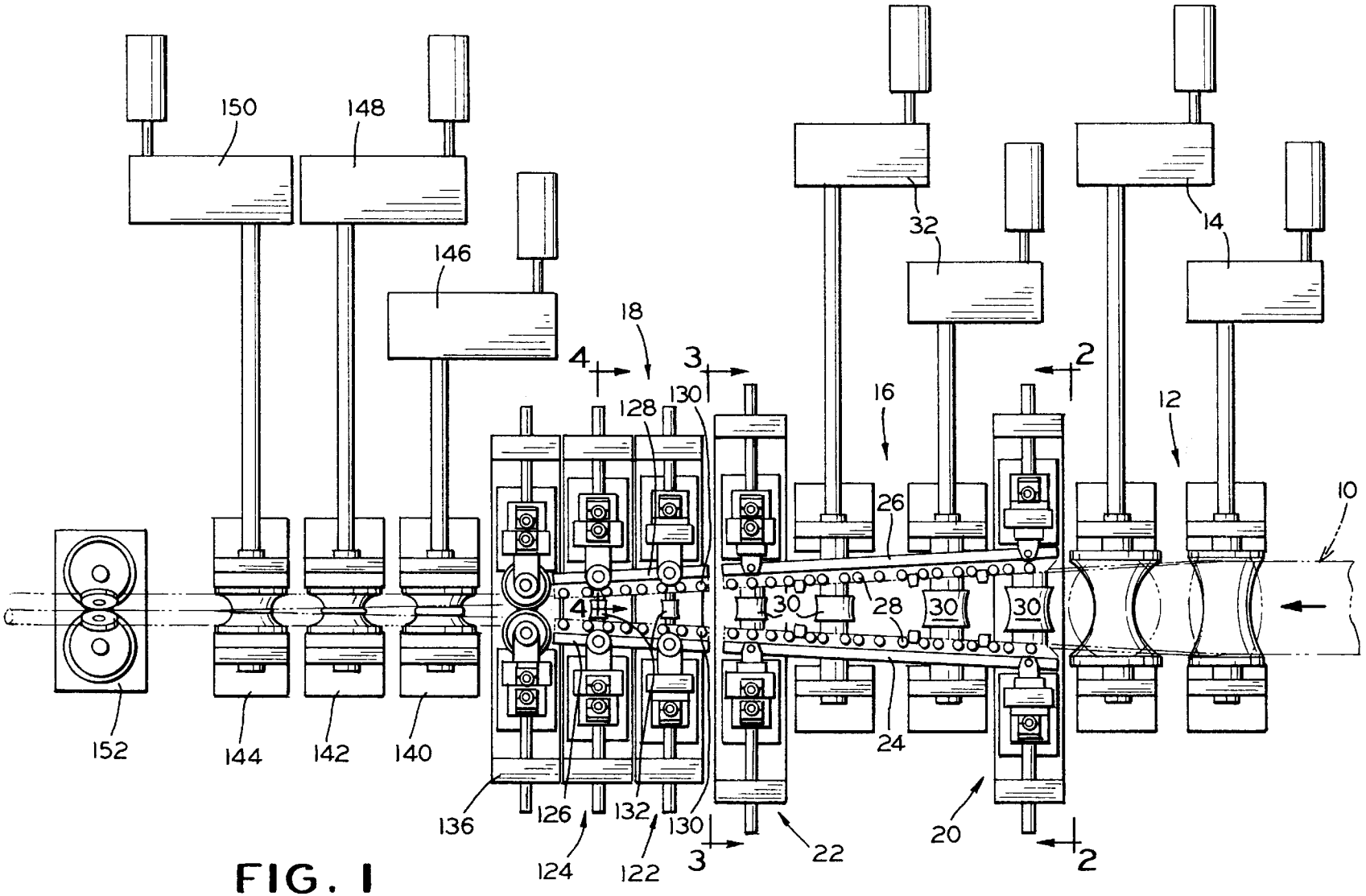
FIG. 1 is a top plan view of the forming section of a tube mill utilizing the structural concepts of the present invention.

Referring to the drawings, there is shown a preferred embodiment of the invention wherein like reference numerals are employed to designate similar parts throughout the entire description.

FIG. 1 shows a top plan view of the forming sections of a tube mill wherein the principle features of the invention are incorporated. As illustrated in FIG. 1, the entry end of the tube mill is at the right hand side and the exit end is at the left hand side.

The production of metal tubing in mill equipment of the type which could suitably incorporate the structural concepts of the present invention typically utilizes metal strip stock or skelp 10 from which the resultant tubing to be formed is fed from a driven pinch roll assembly (not shown) to an initial forming section 12 oftentimes referred to as the breakdown section. The section 12 typically includes at least one pair of cooperating forming rolls at least one of which is positively driven by conventional drive units 14, for example. During the passage, the forming section 12, the cross-section of the metal strip 10 is caused to be converted from a flat cross-sectional configuration to a generally U-shaped configuration. As the metal strip 10 exits from the forming section 12, it is U-shaped in cross-section so as to be received in the next adjacent forming section herein referred to as the transition section and is comprised of two subsections 16 and 18.

The transition subsection 16 includes a multiple roll assembly, an entrance stand 20, and an exit stand 22. The stands 20 and 22 movably support the ends of longitudinally extending, spaced apart transition beams 24 and 26 each of which is adopted to carry an equal number of individual roll assemblies 28.

The transition subsection 16 also includes a number of longitudinally spaced apart bottom support rolls 30 for supporting the bottom surface of the transient metal strip 10 as it travels through the various stages of the roll assemblies of the forming sections. Certain of the support rolls 30 are positively driven by conventional drive units 32.

Figure 2:
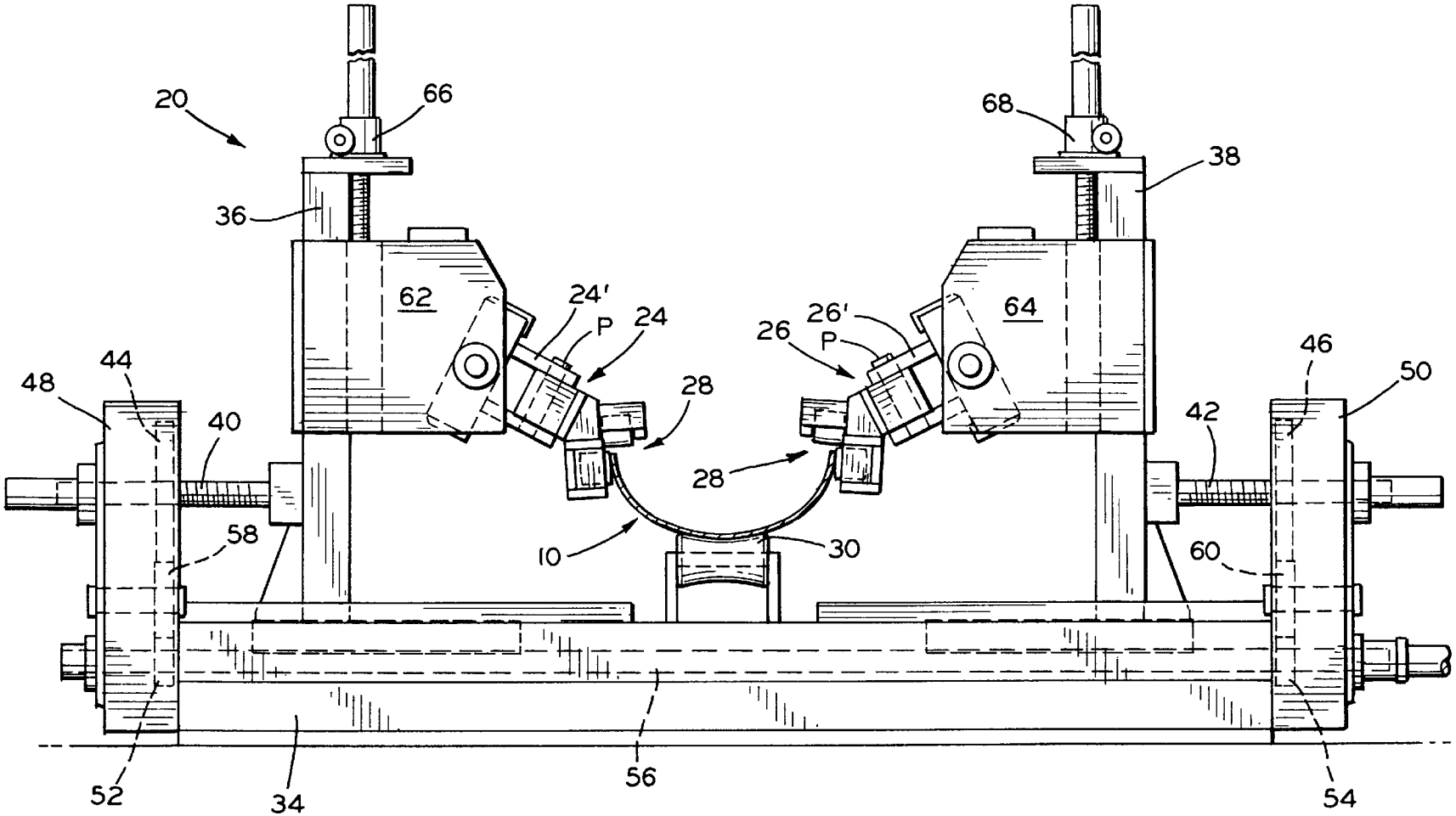
FIG. 2 is a sectional view of the entrance end of the transition beam section of the tube mill taken along line 2—2 of FIG. 1.
Figure 3:
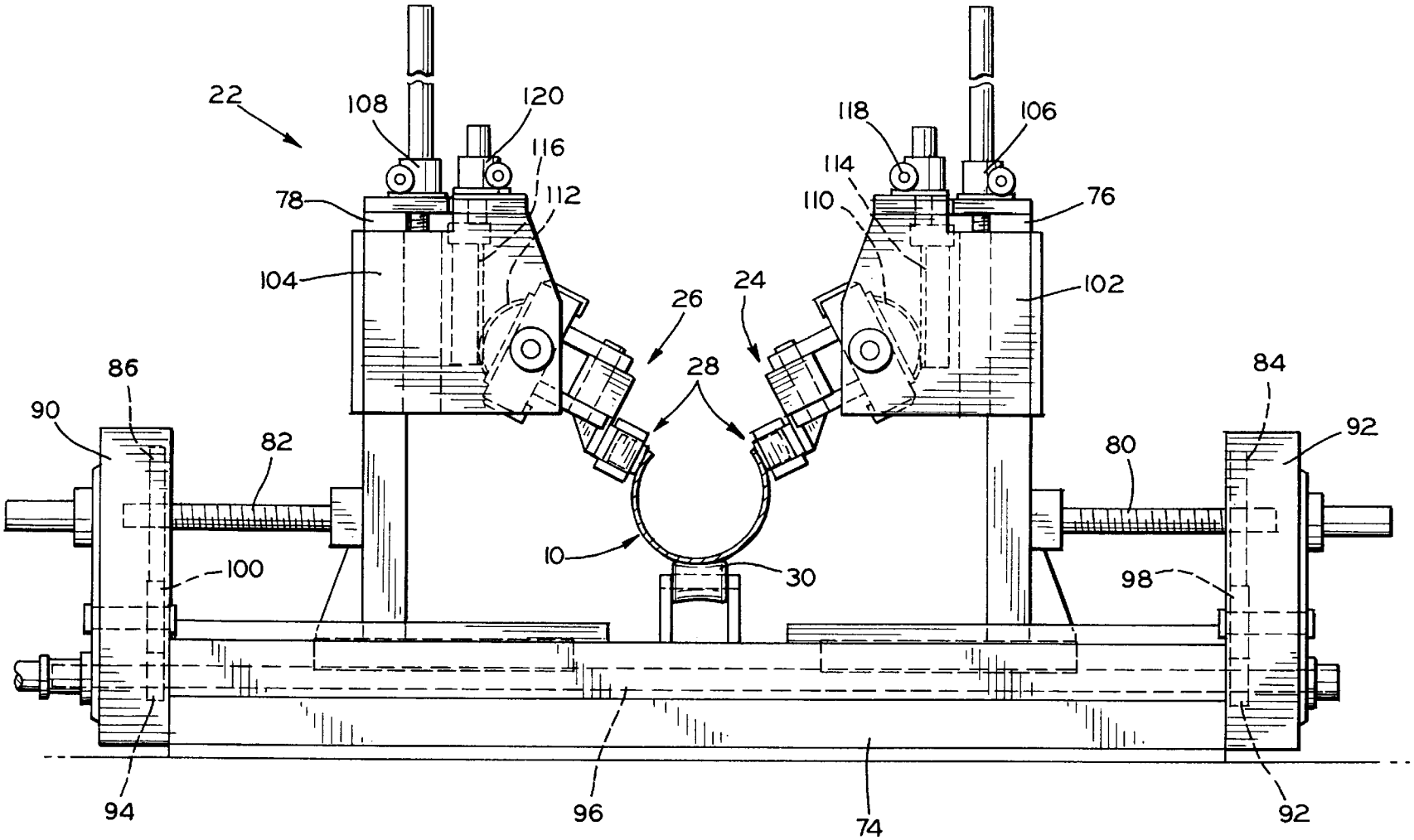
FIG. 3 is a sectional view taken along line 3—3 of FIG. 1 showing the outlet end of the first transition beam section.

The stands 20 and 22, illustrated in FIG. 2 and 3, respectively, are aligned relative to each other and each of the stands extends transversely of the longitudinal axis of the transition subsection 16. The structure of each of the stands 20 and 22 is similar.

The entrance stand 20 includes a transversely extending base member 34 supporting a pair of spaced apart upstanding upright members 36 and 38. The members 36 and 38 are slidable within suitable horizontally extending guyways, not specifically illustrated. Synchronized relative horizontal movement of the upright members 36 and 38 normal to the longitudinal axis of the mill may be effected by respective lead screws 40 and 42 each of which is suitably affixed to its respective upright member. The lead screws 40 and 42 are respectively threadably received within internally threaded gears 44, 46 journalled within gear housings 48, 50, respectively. The gears 44, 46 and driven by gears 52, 54 keyed to a common drive shaft 56. The gears 44, 46 are driven by the gears 52, 54 through idle gears 58, 60, respectively.

The entrance ends of the beam members 24, 26 are rotatingly mounted in slide members 62, 64 through respective clevis members 24', 26'. The slide members 62, 64, in turn, are slidably mounted on the upright members 36, 38, respectively. Vertical movement of the slide members 62, 64 is effected by independently operated jack screw assemblies 66, 68, respectively.

The roll assemblies 28 are suitably attached to the respective transition beams 24, 26 by associated clevis members.

The exit stand 22 includes a transversely extending base member 74 supporting a pair of spaced apart upstanding upright members 76 and 78. The members 76 and 78 are slidable within suitable horizontally extending guyways, not specifically illustrated. Synchronized relative horizontal movement of the upright members 76 and 78 normal to the longitudinal axis of the mill may be effected by respective lead screws 80 and 82 each of which is suitably affixed to its respective upright member. The lead screws 80 and 82 are respectively threadably received within internally threaded gears 84, 86 journalled within gear housings 98, 92, respectively. The gears 84, 86 are driven by gears 92, 94 keyed to a common drive shaft 96. The gears 84, 86 are driven by the gears 92, 94 through idle gears 98, 100, respectively.

The exit ends of the transition beams 24 and 26 are rotatably mounted in slide members 102, 104, which, in turn, are slidably mounted on the upright members 76 and 78, respectively. Vertical movement of the slide members 102, 104 is effected by independently operated jack screw assemblies 106, 108, respectively.

As illustrated in FIG. 3, pivotal movement of the beams 24 and 26 is achieved by affixing pinion sectors 110, 112 to the clevis members supporting the beams 24, 26, respectively. Associated rack elements 114, 116 are provided to engage respective pinion sections 110, 112. Specific vertical movement of the rack elements 114, 116 is effected through independently adjustable jack screws 118, 120, respectively. Vertical movement of the rack elements 110, 112 will cause simultaneous pivotal movement of the pinion sectors 110, 112 and the associated transition beams 24, 26. Obviously, as the beams 24, 26 are caused to rotate about the axes of the respective clevis member, the roll assemblies 28 will be likewise simultaneously accurately adjusted.

Figure 5:
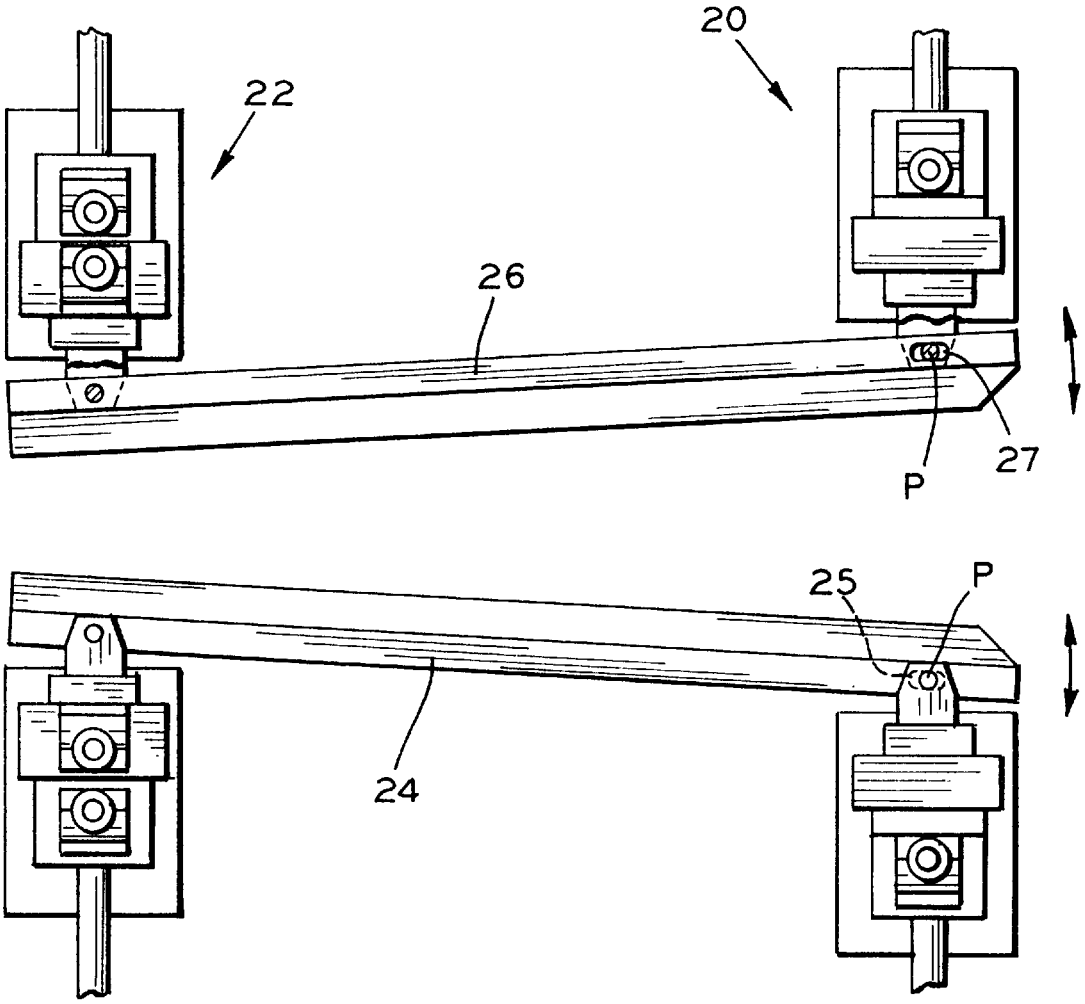
FIG. 5 is an enlarged fragmentary diagrammatic plan view of the transition subsection illustrated in FIG. 1.

In order to compensate for the changes in horizontal and vertical displacement of the exit ends of the beams 24, 26, the beams 24, 26 are provided with slots 25, 27 respectively, as illustrated in FIG. 5. The bearings 24, 26 are pivotally interconnected to the respective clevis member by pin means P.

The transition beam subsection 18 includes a number of cluster roll assemblies, an entrance stand 122 and an exit stand 124. The stands 122 and 124 movably support the ends of longitudinally extending spaced apart transition beams 126 and 128 each of which is adapted to carry an equal number of individual roll assemblies 130.

The transition subsection 18 also includes a number of longitudinally spaced apart bottom support rolls 132 for supporting the bottom surface of the transient strip 10 as it travels through the subsection 18.

The entrance stand 122 and the exit stand 124 of the subsection 18 are substantially identical with the entrance stand 20 and the exit stand 22, respectively, of the subsection 16.

The entrance ends of the transition beams 126 and 128 are rotatingly mounted in slide members which may be moved vertically in upstanding upright members which, in turn, may be moved horizontally normal to the longitudinal axis of the mill.

Similarly the exit ends of the transition beams 126 and 128 are rotatingly mounted in slide members which may be moved vertically in upstanding upright members which, in turn, may be moved horizontally normal to the longitudinal axis of the mill.

The exit ends of the transition beams 126 and 128, like the beams 24 and 26, are provided with power means such as the rack and pinion sector gear arrangement of the subsection 16.

Therefore, the transition beams of both the subsections 16 and 18 are mounted in a similar fashion wherein the ends of the beams are idly pivotally mounted in respect of one stand and the opposite ends are mounted to be positively rotated by a rack and pinion gear arrangement, for example.

After the formed strip 10 passes through and exits the stand 124, it is caused to travel through a cluster roll assembly of a stand 136.

In order to maintain the desired alignment of the formed strip 10 prior to being resistance welded, it is caused to pass through a series of driven fin roll assemblies 140, 142, 144. The fin roll assemblies 140, 142, 144 may be positively driven by respective conventional drive nuts 146, 148, 150, respectively.

Finally, the strip 10 has been completely formed into a tubular shape wherein the outermost edges of the strip as it entered the mill have been brought into intimate contact. In such condition, the tube is caused to pass through a resistance welder assembly 152.

Figure 4:
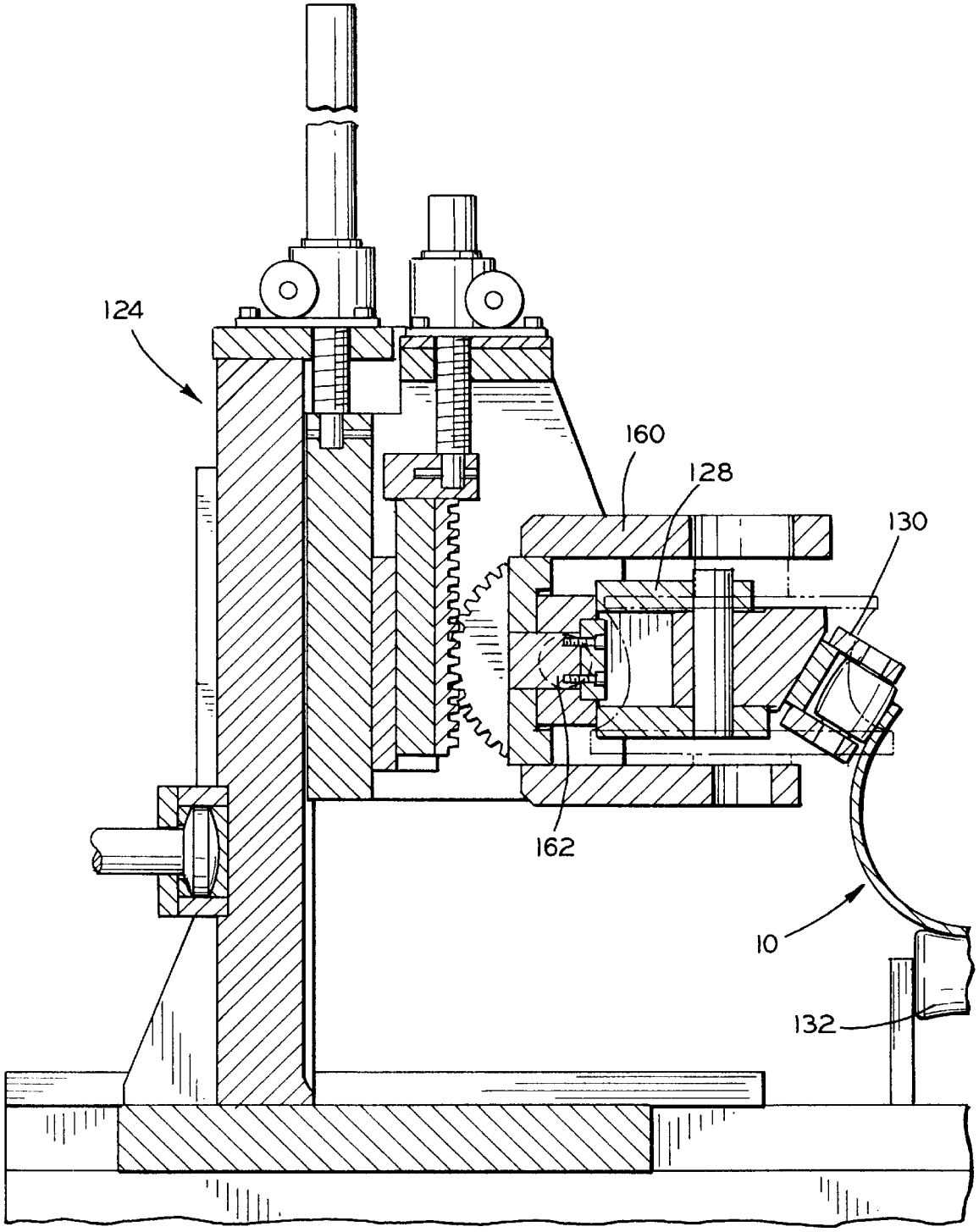
FIG. 4 is a sectional view taken along line 4—4 of FIG. 1 showing the outlet end of the second transition beam section.

In order to manifest the flexibility of the invention, attention is directed to FIG. 4 wherein the exit stand 124 of the transition beam subsection 18 showing the specific manner the exit end of the beam member 128 is mounted. As illustrated, the beam 128 is affixed to a clevis 160 by a bracket 162. The clevis 160 is rotably mounted to a slide member of the stand 124. A rack and pinion is illustrated for effecting rotary movement of the clevis 160 and the associated beam 128. Vertical movement is achieved by the jack screw assembly.

However, there are certain instances when the transition beam subsection 16 is employed as illustrated and the beam members 126 and 128 of FIG. 1 are replaced by cluster roll assemblies, one roll of which is illustrated in phantom in FIG. 4. More specifically, the conversion is brought about by loosening the bracket 162 from the interior of the clevis 160 to permit withdrawal of the one end of the beam 128. Similar procedure is followed at the entrance stand 122. The beams 126 and 128 are then replaced by cluster rolls which are suitably journalled in the respective clevis to rotate about a generally vertical axis.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A transition forming unit having a longitudinal axis for producing a tubing of annular cross-sectional configuration from a strip of U-shaped cross-sectional configuration traveling along the longitudinal axis of the forming unit, the forming unit including an entrance end and an exit end and comprising:

a pair of longitudinally extending beams each having an entrance end, and exit end, and an axis, one of said beams disposed on each side of and extending along the longitudinal axis of the transition forming unit between the entrance end and the exit end thereof;

an array of spaced apart roll assemblies extending longitudinally along said beams, each of said roll assemblies including at least one pair of cooperating rollers, one roller of which is mounted on respective ones of said beams, the rollers adapted to engage the outer surface of the strip being formed;

first adjustment means for selective horizontal and vertical movement of the entrance end of said beams to orient the axes of the beams in selected positions relative to the axis of the forming unit;

second adjustment means for selective horizontal and vertical movement of the exit end of said beams to orient the axes of the beams in selected positions relative to the axis of the forming unit;

first clevis means pivotally interconnecting the entrance ends of said beams to respective ones of said first adjustment means;

second clevis means pivotally interconnecting the exit ends of said beams to respective ones of said second adjustment means, and rack and pinion means interconnecting said first and second adjustment means and respective ones of said first and second clevis means for rotating respective first and second clevis means about a horizontal axis to effect simultaneous movement of respective ones of said beams and associated roll assemblies.

2. The invention defined in claim 1 wherein said first and second adjustment means includes at least two longitudinally spaced support stands for mutually mounting said beams including means operative to shift said beams along respective horizontal paths relative to and in synchronism with each other, and means operative to change the vertical position of said beams.

* * * * *